US007247009B2

(12) United States Patent
Sun

(10) Patent No.: US 7,247,009 B2
(45) Date of Patent: Jul. 24, 2007

(54) SCROLL COMPRESSOR WITH SLIDER BLOCK HAVING UPPER SURFACE OVER ENLARGED AREA

(75) Inventor: Zili Sun, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 12 days.

(21) Appl. No.: 11/239,813

(22) Filed: Sep. 30, 2005

(65) Prior Publication Data

US 2007/0077160 A1 Apr. 5, 2007

(51) Int. Cl.
*F03C 2/00* (2006.01)
*F04C 2/00* (2006.01)
*F04C 18/00* (2006.01)

(52) U.S. Cl. ..... 418/55.5; 418/55.1; 418/57

(58) Field of Classification Search ..... 418/55.1–55.6, 418/57

See application file for complete search history.

(56) References Cited

U.S. PATENT DOCUMENTS

| | | | | |
|---|---|---|---|---|
| 5,197,868 | A | 3/1993 | Caillat | |
| 5,378,129 | A * | 1/1995 | Dunaevsky et al. | 418/55.5 |
| 5,496,158 | A * | 3/1996 | Barito et al. | 418/55.5 |
| 5,772,415 | A * | 6/1998 | Monnier et al. | 418/55.5 |
| 6,053,714 | A | 4/2000 | Fenocchi | |
| 6,082,495 | A * | 7/2000 | Steinbarger et al. | 418/55.6 |
| 6,264,445 | B1 * | 7/2001 | Beck et al. | 418/55.5 |

* cited by examiner

*Primary Examiner*—Theresa Trieu
(74) *Attorney, Agent, or Firm*—Carlson, Gaskey & Olds, PC

(57) ABSTRACT

A scroll compressor has a novel slider block with an upper surface that extends for a greater extent than the prior art. By extending this upper surface, the upper surface is better able to withstand wear on the slider block during the life of the scroll compressor.

5 Claims, 2 Drawing Sheets

SCROLL COMPRESSOR WITH SLIDER BLOCK HAVING UPPER SURFACE OVER ENLARGED AREA

BACKGROUND OF THE INVENTION

This application relates to a slider block for a scroll compressor, wherein a top surface extends upwardly from a nominal surface to provide an oil gap, and wherein this top surface extends for at least 90° and less than 180° to provide an adequate amount of surface area.

Scroll compressors are becoming widely utilized in refrigerant compression applications. In a scroll compressor, a pair of scroll members orbit relative to each other. Generally spiral wraps on the two scroll members move relative to each other during this orbital movement to entrap and then compress a refrigerant.

An electric motor drives an orbiting scroll member to orbit. An eccentric pin on a driveshaft extends upwardly into a slider block. The slider block extends upwardly into a boss extending downwardly from the orbiting scroll member. Oil passes through an oil passage through the shaft, and through the eccentric pin.

In the prior art, it is known to combine a plurality of spaced and small upwardly extending bumps on the upper surface of the slider block. The bumps ensure that a large nominal surface of the slider block is spaced by at least a defined gap from an inner face of the orbiting scroll boss when the slider block occasionally travels up against the inner face of the orbiting scroll boss. This gap ensures that lubricant having passed through the oil passage can circulate along the nominal surface of the slider block, between the eccentric pin and the slider block, and between the slider block and the boss.

The prior art having the discrete bumps has a problem with longevity. In particular, the bumps are formed over a relatively small surface area, and are subject to wear. Thus, in the prior art, these bumps have sometimes become worn prematurely, and then there have been challenges in providing adequate lubrication.

SUMMARY OF THE INVENTION

In a disclosed embodiment of this invention, a slider block for a scroll compressor has an upper surface that extends upwardly from a nominal surface of the slider block. This upper surface extends for at least 90°, and less than 180° about a central axis of the slider block. In a disclosed embodiment, the upper surface extends for 120°. Ramps connect the upper surface to the nominal surface.

By providing this greater surface area, the present invention ensures that there will be a good deal of additional surface area to withstand wear during the life of the scroll compressor.

These and other features of the present invention can be best understood from the following specification and drawings, the following of which is a brief description.

DETAILED DESCRIPTION OF THE PREFERRED EMBODIMENT

Figure 1:
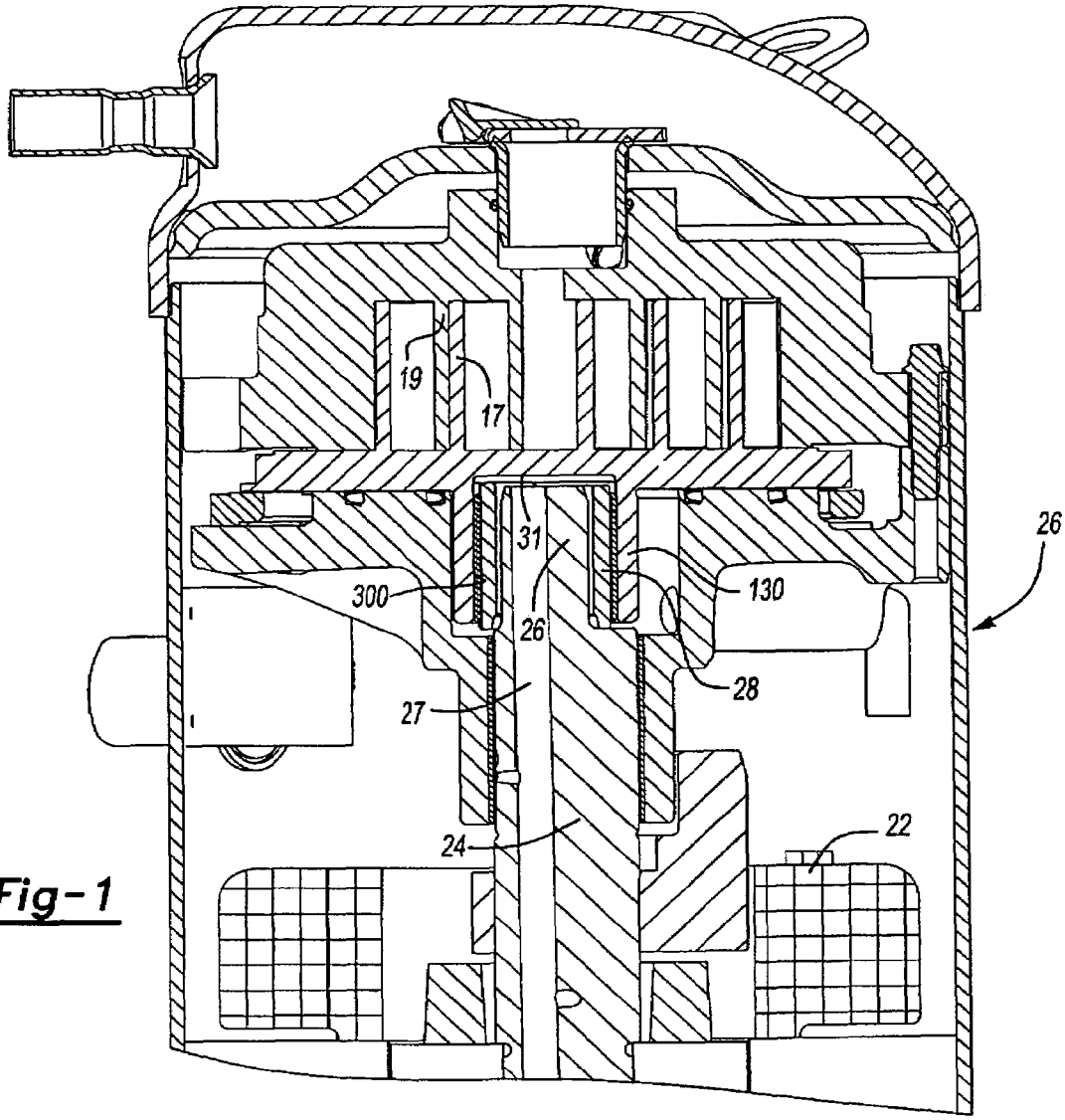
FIG. 1 is a cross-sectional view through a scroll compressor.

A scroll compressor 20 is illustrated in FIG. 1, having a motor 22 driving a driveshaft 24. An eccentric pin 26 extends upwardly from the driveshaft 24 and into a slider block 28. Slider block 28 is received in a bore 300 within a boss 130 extending downwardly from an orbiting scroll member 17. As known, the orbiting scroll 17 interfits with a non-orbiting scroll 19 to define compression chambers. An inner face 31 of the boss 130 defines a stop surface for the slider block 28. As known, an oil passage 27 extends upwardly through the driveshaft 24, and supplies oil into the area between the upper end of the eccentric pin 26 and the face 31 of the orbiting scroll 17. The present invention is directed to ensuring there is an adequate gap in this location to allow the oil to flow freely outwardly of the passage 27.

Figure 2:
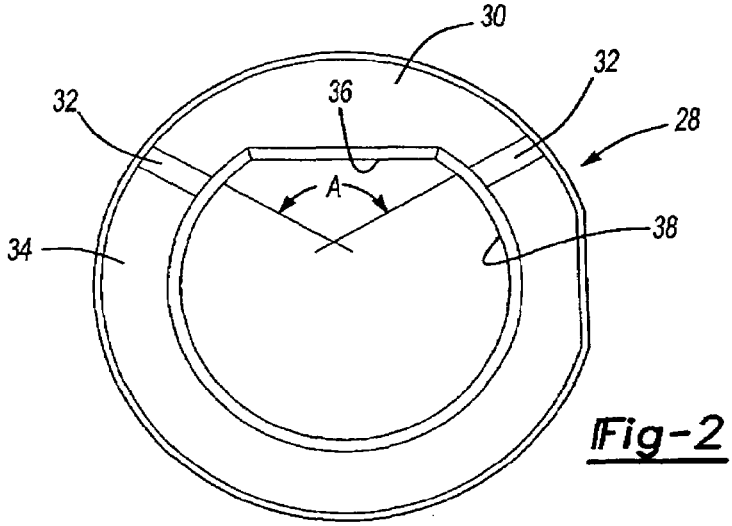
FIG. 2 is a top view of an inventive slider block.

As shown in FIG. 2, the inventive slider block 28 has an upper surface 30, ramped surfaces 32 extending downwardly to a nominal surface 34. As known, a flat drive surface 36 is positioned within an inner surface of the slider block, and contacts a flat surface on the eccentric pin (see FIG. 3 and flat surface 120 on the pin 26). A curved portion 38 connects the ends of the flat 36. The upper surface 30 extends around the flat drive surface 36.

The upper surface 30 extends for an angle A. The angle A is between 90° and 180°. With a greater range, there could be a restriction of the flow of oil, while a lesser range might not provide adequate wear protection. In a disclosed embodiment, the angle A is 120°. The height of the upper surface 30 compared to the nominal surface 34 may be generally equal to the height of the prior art bumps, or in a range of 0.2 to 2.0 mm.

Figure 3:
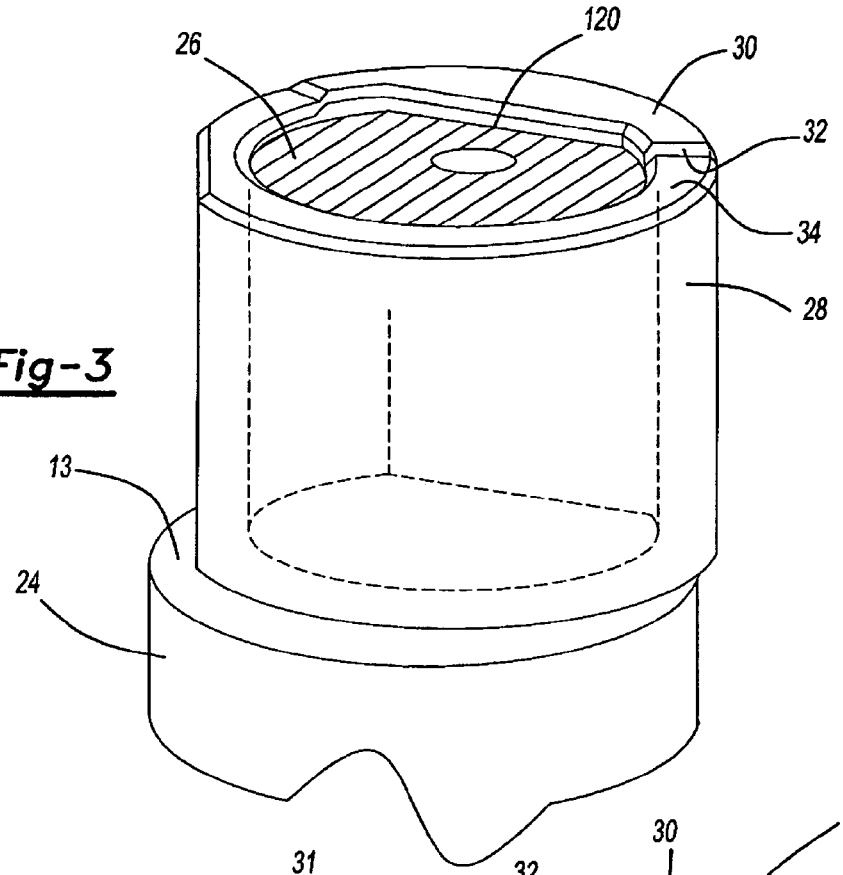
FIG. 3 is a perspective view of a slider block and driveshaft.
Figure 4:
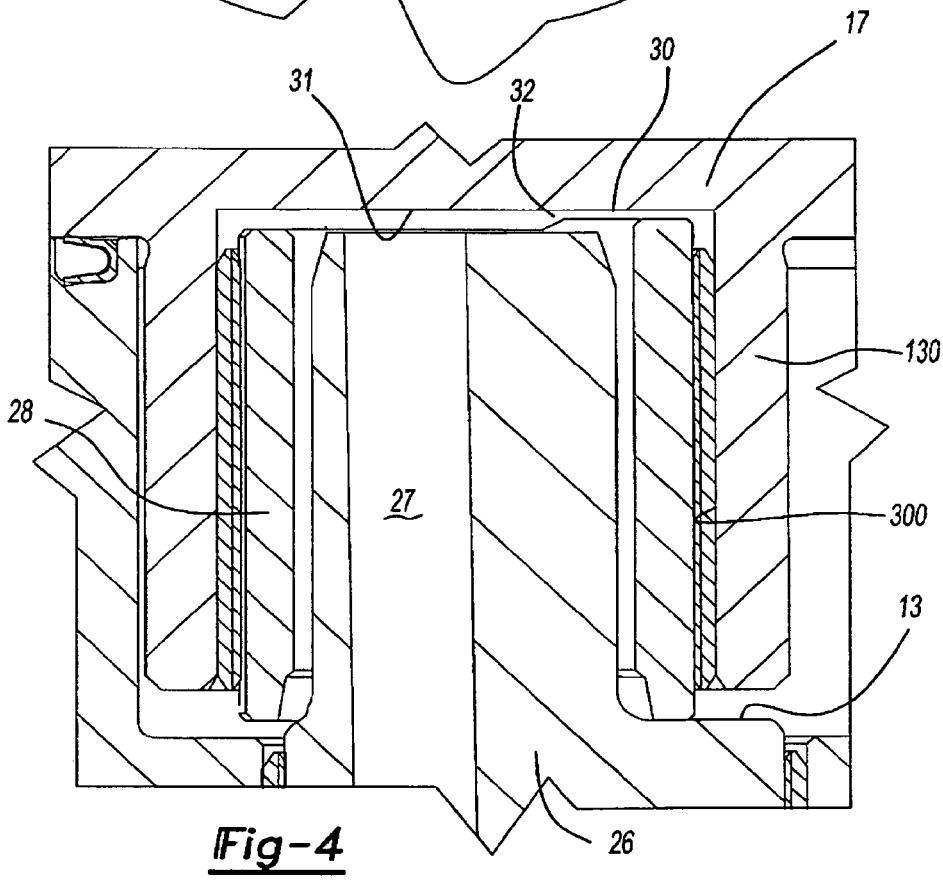
FIG. 4 is a cross-sectional view through the inventive slider block.

As shown in FIG. 3, the eccentric pin 26 extends eccentrically upwardly from a cylindrical portion 13 of the driveshaft 24. The slider block 28 normally sits on the portion 13. As can be appreciated from this figure and from the cross-section of FIG. 4, the upper surface 30 contacts the face 31 on the orbiting scroll 17 when the slider block moves up occasionally. The use of the relatively large surface 30 provides a good deal of wear protection when compared to the prior art, and ensures that the slider block will be longer lived than the prior art.

Although a preferred embodiment of this invention has been disclosed, a worker of ordinary skill in this art would recognize that certain modifications would come within the scope of this invention. For that reason, the following claims should be studied to determine the true scope and content of this invention.

The invention claimed is:

1. A scroll compressor comprising:

a first scroll member having a base and a generally spiral wrap extending from said base;

a second scroll member having a base and a generally spiral wrap extending from its base, said second scroll member having a boss extending from an opposed side of said base relative to said generally spiral wrap, said boss defining an inner bore and having an end face;

a motor driving a driveshaft, said driveshaft having an eccentric pin extending upwardly and into said inner bore in said boss; and a slider block positioned between said eccentric pin and said inner bore, said slider block having a nominal surface, and a vertical upper surface spaced beyond said nominal surface, and towards said end face of said orbiting scroll, said vertically upper surface extending for an angular extent of said eccentric pin of between 90° and 180°.

2. The scroll compressor as set forth in claim 1, wherein said slider block has an inner bore with a flat to contact a surface on said eccentric pin to drive said second scroll member to orbit, and said vertically upper surface extending through an angular extent that encompasses said flat.

3. The scroll compressor as set forth in claim 1, wherein said vertically upper surface has ramps at each circumferential extent merging into said nominal surface.

4. The scroll compressor as set forth in claim 1, wherein said angle is 120°.

5. A scroll compressor comprising:

a first scroll member having a base and a generally spiral wrap extending from said base;

a second scroll member having a base and a generally spiral wrap extending from its base, said second scroll member having a boss extending from an opposed side of said base relative to said generally spiral wrap, said boss defining an inner bore and having an end face;

a motor driving a driveshaft, said driveshaft having an eccentric pin extending upwardly and into said inner bore in said boss;

a slider block positioned between said eccentric pin and said inner bore, said slider block having a nominal surface, and a vertical upper surface spaced beyond said nominal surface, and towards said end face of said orbiting scroll, said vertically upper surface extending for an angular extent of between 90° and 180°; and said slider block has an inner bore with a flat to contact a surface on said eccentric pin to drive said second scroll member to orbit, and said vertically upper surface extending through an angular extent that encompasses said flat, said vertically upper surface has ramps at each circumferential extent merging into said nominal upper surface.

* * * * *